United States Patent [19]

Holson

[11] 4,114,300

[45] Sep. 19, 1978

[54] PHOTO ALBUM COVER WITH FRAMED INSERTS

[75] Inventor: Sheldon Holson, Norwalk, N.Y.

[73] Assignee: The Holson Co., Wilton, Conn.

[21] Appl. No.: 768,992

[22] Filed: Feb. 16, 1977

[51] Int. Cl.[2] ..... G09F 1/12

[52] U.S. Cl. ..... 40/152; 281/31

[58] Field of Search ..... 40/10, 152, 156; 281/31

[56] References Cited

U.S. PATENT DOCUMENTS

| | | | |
|---|---|---|---|
| 1,446,082 | 2/1923 | Applegate | 40/156 |
| 1,710,483 | 4/1929 | Kraushar | 40/156 |
| 2,506,509 | 5/1950 | Krakowski | 40/152 |
| 2,603,017 | 7/1952 | Merrill | 40/152 |
| 3,818,187 | 11/1975 | Vogele | 40/156 |
| 3,988,846 | 11/1976 | Kuhling | 44/156 |
| 4,001,960 | 1/1977 | Holson | 281/31 |

*Primary Examiner*—Russell R. Kinsey
*Assistant Examiner*—Wenceslao J. Contreras

[57] ABSTRACT

A padded type photo album cover construction incorporating a two piece frame disposed within an opening therein for supporting a plurality of photographic prints in exposed condition in substantially the planes of the inner and outer surfaces of the cover. The construction may be incorporated into albums already existing.

5 Claims, 4 Drawing Figures

PHOTO ALBUM COVER WITH FRAMED INSERTS

BRIEF DISCUSSION OF THE PRIOR ART

The manufacture of padded photo album covers including a relatively stiff base of cardboard and a laminated layer of synthetic resinous foam material, in turn covered by a layer of decorative vinyl material, is well known in the art. Although not expensive, it provides the appearance of a leather bound volume, and a soft feel or hand to the vinyl layer akin to that of genuine leather. Such albums have found wide acceptance among both professional and amateur photographers. In such applications, however, unless the cover is hot stamped or otherwise labeled, the individual identification of such albums with respect to the subject matter of the contents is not an easy matter. In the absence of imprinting a name or title, a convenient way of providing identification is the exposure of a single photograph which suggests the nature of the contents. Attachment of such photograph to an outer surface of the album invites damage with the continued use of the album, thereby destroying the indicia and adversely effecting the appearance of the album. Such a procedure has not been wide accepted in the prior art. In my recently granted prior patent, U.S. Pat. No. 4,001,961, of Jan. 11, 1977, there is disclosed a unitary metallic frame element which is inserted in the front cover of an album by first die cutting an opening corresponding to the outer configuration of the insert, following which the insert is pushed into the opening to be retained by a peripheral bead which overlies portions of the outer surface of the cover surrounding the cut opening, and a laterally extending flange which similarly engages the inner surface of the cover. The portion which has been cut to form the opening is used as a backing to hold a photograph in position within the insert behind an orifice. While useful and attractive, this construction is not inexpensive, since it is difficult to mold from synthetic resinous materials, and forming the insert of metal requires plural drawing and sizing operations. Further, the inner surface of the front cover cannot be used to display a second photograph, as is often desired.

SUMMARY OF THE INVENTION

Briefly stated, the invention contemplates the provision of a pair of mutually engageable picture frames positioned in a corresponding opening penetrating the plane of the front cover of a padded photographic album. The frames are each formed to include a peripheral flange capable of engaging the edges of the cut opening in the cover to be retained against movement thereby, the mutual engagement of the frames maintaining the flanges in contact with said edges and further provides a recess for the reception of one or more photographic prints which are thereby positioned substantially in the plane of the cover, each print being viewable from either the inner surface or outer surface of the cover. Portions of each frame are positioned to provide a clamping action upon the photographs, which action may be supplemented by the insertion of a spacer which abuts the inner surface of each photograph, and adds rigidity to the photographs so that they are not readily dislodged. The invention has application in cheaper constructions, in which the foam layer of the cover is eliminated.

BRIEF DESCRIPTION OF THE DRAWING

In the drawing, to which reference is made in the specification, similar reference characters have been employed to designate corresponding parts throughout the several views.

DETAILED DESCRIPTION OF THE DISCLOSED EMBODIMENT

Figure 1:
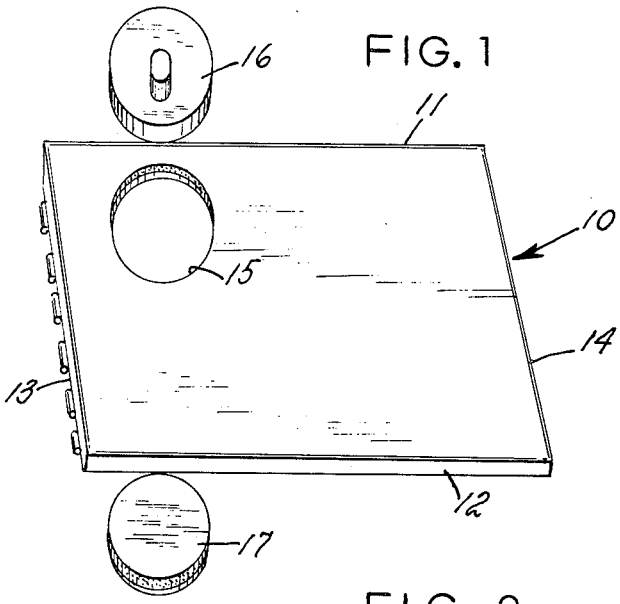
FIG. 1 is an exploded view in perspective of an embodiment of the invention, showing a stage of manufacture.
Figure 2:
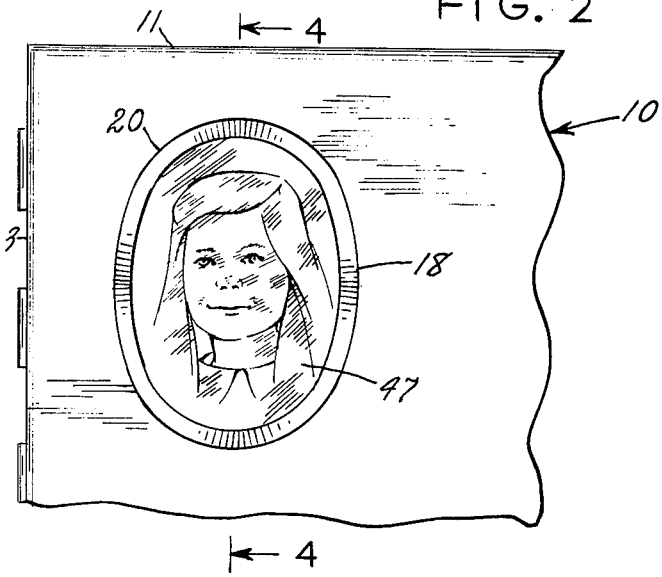
FIG. 2 is an enlarged fragmentary front elevational view thereof.
Figure 3:
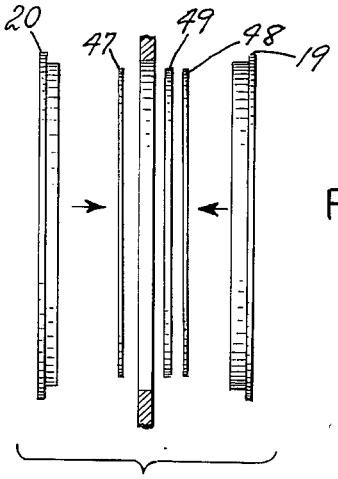
FIG. 3 is an exploded fragmentary vertical sectional view, partly in elevation, of a frame elment forming a part of the embodiment.

In accordance with the invention, the device, generally indicated by reference character 10 is illustrated in FIG. 1 of the drawing as an upper cover of a photographic album, which may be interconnected to a corresponding lower cover (not shown) to enclose a plurality of album pages. As the details of such interconnection are well known in the art, they form no part of the present disclosure, and need not be considered further herein. The cover 10 is bounded by an upper edge 11, a lower edge 12, a captive end edge 13 and a free edge 14. A through-opening 15 of desired shape, such as the ovoid shape illustrated is formed using a correspondingly shaped suitable die 16. Unlike the case in the above mentioned patent, the cut portion 17 is not utilized in the present embodiment, and may be discarded.

Engaging the opening 15 is a frame element 18 including a first outer element 19 and a second inner element 20, which are preferably formed as injection moldings from synthetic resinous material, and may, if desired, be suitably metalized to offer an improved appearance.

The outer element 19 includes an inwardly tapered wall 22 integrally formed with an axially oriented wall 23. The wall 22 is bounded by an outer beaded edge 25, an outer tapered surface 26, an inner planar edge surface 27 and an inner surface 28 generally parallel to the surface 26. The axially oriented wall 23 is bounded by an outer arcuate surface 31, an inner edge surface 32 and an inner arcuate surface 33.

Figure 4:
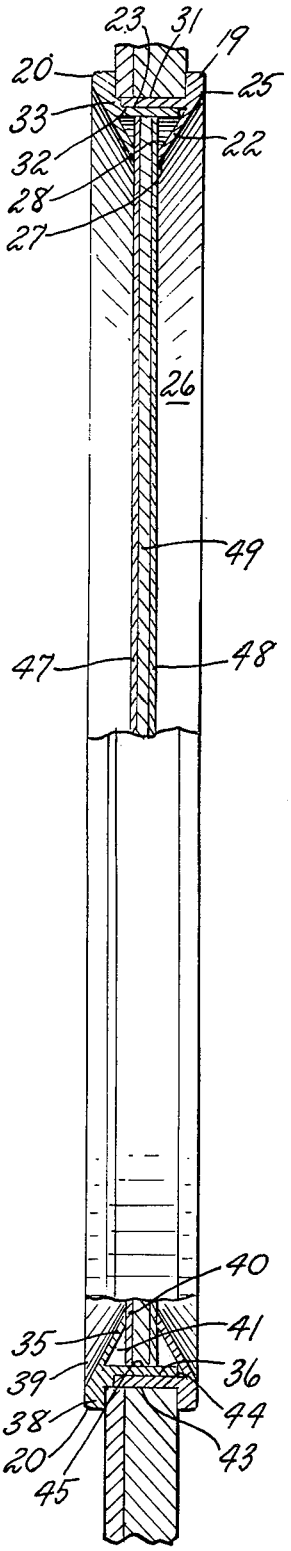
FIG. 4 is an enlarged fragmentary vertical sectional view as seen from the plane 4—4 in FIG. 2.

The second inner element 20 is generally similar, and is adapted to nest as shown in FIG. 4 with the element 19. It includes an inwardly tapered wall 35 and an axially oriented wall 36. The wall 35 includes an outer beaded edge 38, an outer tapered surface 39, an inner planar edge surface 40 and an inner surface 41 parallel to the surface 39. The wall 36 includes an outer arcuate surface 43, an inner edge surface 44 and an inner arcuate surface 45. To assist in frictional retention after nesting, the outer arcuate surface 43 and the inner arcuate surface 33 may be slightly beveled to a degree not shown in the drawing, to obtain a wedging effect when assembled.

FIG. 4 illustrates the assembly of the frame element 18 within the opening 15, such that the inner planar edge surface 40 is disposed opposite the inner planar edge surface 27 to form a clamping effect upon a pair of first and second photographic prints 47–48. Where the prints are made on paper which is sufficiently thick, the back surfaces thereof may be allowed to contact each other, to provide sufficient rigidity to the display. Where thinner paper is employed, the clamping effect as well as a rigidifying effect may be obtained by the use of a cardboard spacer 49 which is disposed between the photographs 47 and 48 as shown.

Where the use of only one photograph is desired, the side opposite may be used for inserting other indicia, or, in the case of commercial applications, an advertising message may be positioned to be visible from the inner surface of the cover.

It will be apparent that in addition to other advantages, the present construction permits an improved appearance to the inner surface of the album cover, fully equivalent to that on the outer surface thereof. It will be further observed that the clamping effect upon the sandwiched photographic prints is disposed inwardly of the peripheral edges thereof, thereby enabling sufficient purchase on the exposed surfaces of the print to prevent accidental dislodgement in the absence of a very substantial force.

By forming the spacer 49 of transparent material, the same may be used as template in composing the area to be displayed, in the manner taught in my co-pending application Ser. No. 685,393 filed May 11, 1976 entitled PHOTO ALBUM COVER WITH SIMULATED FRAMED INSERT AND MEANS AND METHOD OF COMPLETING SAME.

I wish it to be understood that I do not consider the invention limited to the precise details of structure shown and set forth in this specification, for obvious modifications will occur to those skilled in the art to which the invention pertains.

I claim:

1. In a combination photo album cover and frame engaged therewith, said cover having a principal plane and comprising a plurality of laminated layers, said cover having a through opening extending perpendicular to the plane thereof of given size and configuration, and having outer and inner planar surfaces, the improvement comprising: said frame element including first and second mating frame elements inserted into said opening from first and second sides thereof to mutually engage and present further axial movement thereof with respect to said opening; each of said first and second frame elements having a peripherally disposed inwardly facing surface forming part of a clamping means cooperating with the corresponding surface on the other of said frame elements; whereby upon the positioning of a correspondingly configured photograph within said through opening, and the insertion and engagement of said first and second frame elements, said photograph may be clamped against movement at the peripheral areas thereof between said inwardly facing planar surfaces.

2. The combination in accordance with claim 1, in further combination with at least one photograph in clamped relation between said last mentioned planar surfaces.

3. The combination in accordance with claim 1, in further combination with a pair of photographs placed in back-to-back relation between said last mentioned surfaces.

4. The combination in accordance with claim 3, further characterized in the provision of a space-filling planar member interposed between said first and second photographs.

5. The combination in accordance with claim 1, further characterized in each of said first and second frame elements including an axially oriented wall, surfaces of said wall being frictionally engaged upon the insertion of said frame elements into said opening.

* * * * *